US006216523B1

(12) United States Patent
Sofy et al.

(10) Patent No.: US 6,216,523 B1
(45) Date of Patent: Apr. 17, 2001

(54) SERVO-DRIVE FOR PRESS TRANSFER

(75) Inventors: Hugh Sofy, Troy; Dennis Farhat, Rochester Hills, both of MI (US)

(73) Assignee: HMS Products Co., Troy, MI (US)

( * ) Notice: Subject to any disclaimer, the term of this patent is extended or adjusted under 35 U.S.C. 154(b) by 0 days.

(21) Appl. No.: 09/421,829

(22) Filed: Oct. 20, 1999

(51) Int. Cl.[7] ..... B21D 43/05

(52) U.S. Cl. ..... 72/405.16; 72/405.11; 198/621.1

(58) Field of Search ..... 72/405.16, 405.13, 72/405.11, 405.09, 405.01; 198/621.3, 621.1

(56) References Cited

U.S. PATENT DOCUMENTS

| | | | | |
|---|---|---|---|---|
| Re. 34,581 | | 4/1994 | Sofy et al. | 72/405 |
| 4,540,087 | * | 9/1985 | Mizumoto | 72/405.16 |
| 4,852,381 | | 8/1989 | Sofy | 72/405 |
| 4,895,013 | | 1/1990 | Sofy | 72/405 |
| 5,267,463 | * | 12/1993 | Doyama | 72/405.16 |
| 5,423,202 | * | 6/1995 | Komatsu | 72/405.16 |
| 5,934,125 | * | 8/1999 | Takayama | 72/405.16 |
| 5,937,693 | * | 8/1999 | Endou | 72/405.16 |

* cited by examiner

*Primary Examiner*—Daniel C. Crane
(74) *Attorney, Agent, or Firm*—Howard & Howard

(57) ABSTRACT

A workpiece transfer assembly (10) for a press of the type including a reciprocating member and a series of in-line stations wherein each station is a further progression of the workpiece W forming process includes a workpiece engaging jaw (12) having clasps (14) attached thereto for clasping the workpieces W. The jaw (12) is moved on three axis, first by a lateral motion mechanism (16) for moving the jaw (12) in a horizontal direction and laterally relative to the work stations into and out of workpiece W engagement position. Second, by a vertical motion mechanism (22) for moving the jaw (12) in a vertical direction relative to the workstations. Third, in a linear motion mechanism (40) for moving the jaw (12) in a horizontal direction and linearly relative to the work stations. The assembly (10) includes a reciprocal lateral motor (50) for actuating the lateral motion mechanism (16), a reciprocal vertical motor (52) for actuating the vertical motion mechanism (22), and a linear motor (54) for actuating the linear motion mechanism (40). A controller for programming the motors through a programmed actuation process communicates with the motors.

13 Claims, 7 Drawing Sheets

SERVO-DRIVE FOR PRESS TRANSFER

BACKGROUND OF THE INVENTION

1) Technical Field

This invention relates generally to assemblies used to transfer workpieces through a machine having a reciprocating member. More specifically the invention is related to an assembly which engages the workpieces to move them progressively from one die station to another so that a plurality of sequential operations may be performed on them.

2) Description of the Prior Art

Workpiece transfer assemblies for use in progressive die type punch presses are well known in the art. Transfer assemblies typically derive motion from a ram press which interacts with a combination of cams for moving rotating members in a desired pattern. An example of such a transfer assembly is U.S. Pat. No. 4,833,908 to Sofy, the named inventor of the subject invention.

Increasingly, manufacturing quality standards have required more precise manufacturing processes. To achieve more precision, electronic and computer process control systems have been introduced into the manufacturing environment. A need for this type of control exists in transfer press operations. More specifically, electronic control over a transfer assembly would enhance the die forming process and improve quality by providing improved process control and fault notification.

SUMMARY OF THE INVENTION AND ADVANTAGES

A workpiece transfer assembly for a press of the type including a reciprocating member and a series of in-line stations wherein each station is a further progression of the workpiece forming process includes a workpiece engaging jaw having clasps attached thereto for clasping the workpieces. A lateral motion mechanism moves the jaw in a horizontal direction and laterally relative to the work stations into and out of workpiece engagement position. A vertical motion mechanism moves the jaw in a vertical direction relative to the workstations. A linear motion mechanism moves the jaw in a horizontal direction and linearly relative to the work stations. The assembly includes a reciprocal horizontal motor for actuating the lateral motion mechanism, a reciprocal vertical motor for actuating the vertical motion mechanism, a linear motor for actuating the linear motion mechanism, and a controller for programming the motors through a programmed actuation process.

The subject invention provides the precise workpiece transfer motions and the electronic control over the transfer operation that is essential to meet contemporary process control standards.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
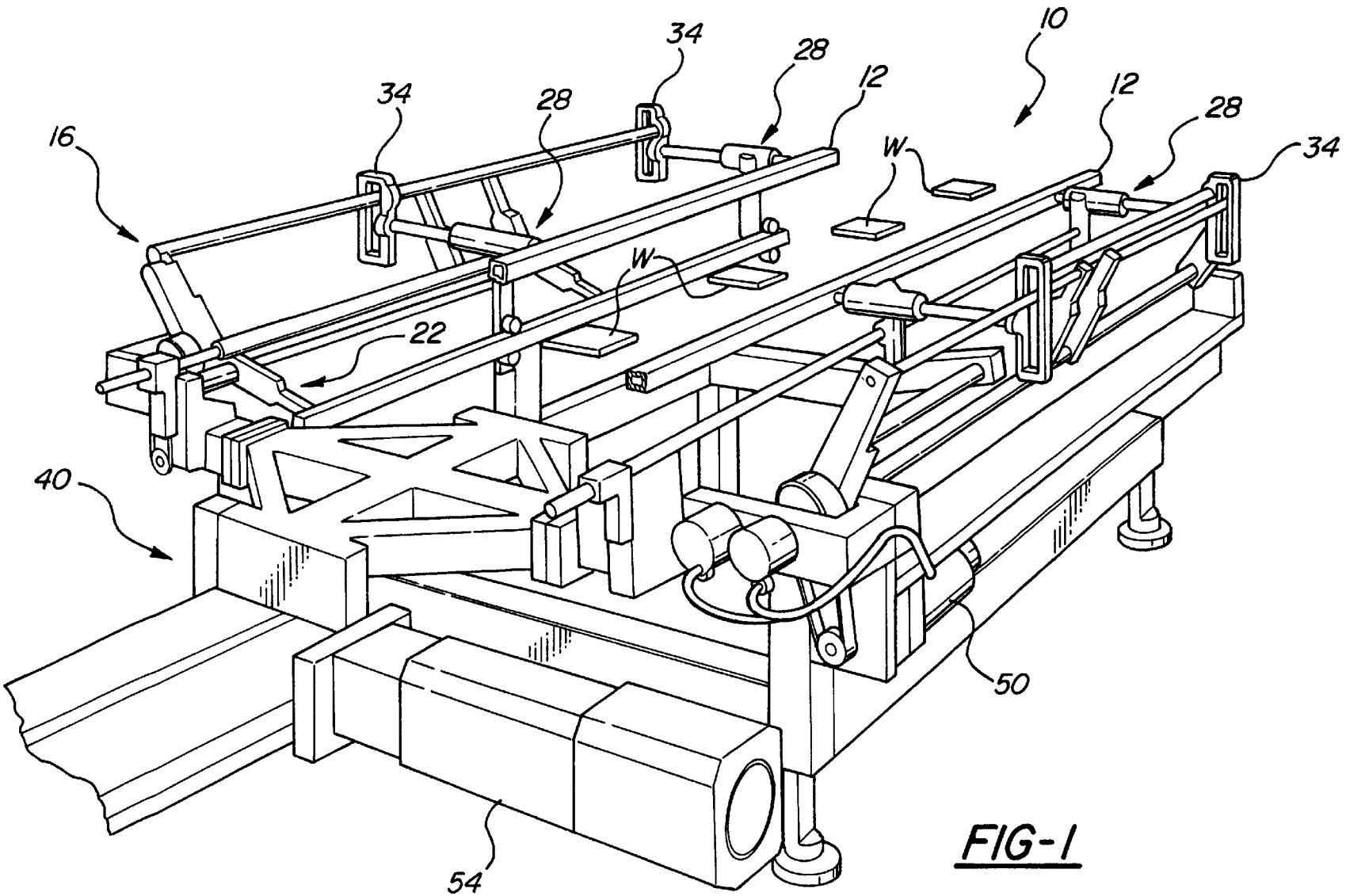
FIG. 1 is a perspective view of the subject invention.
Figure 2:
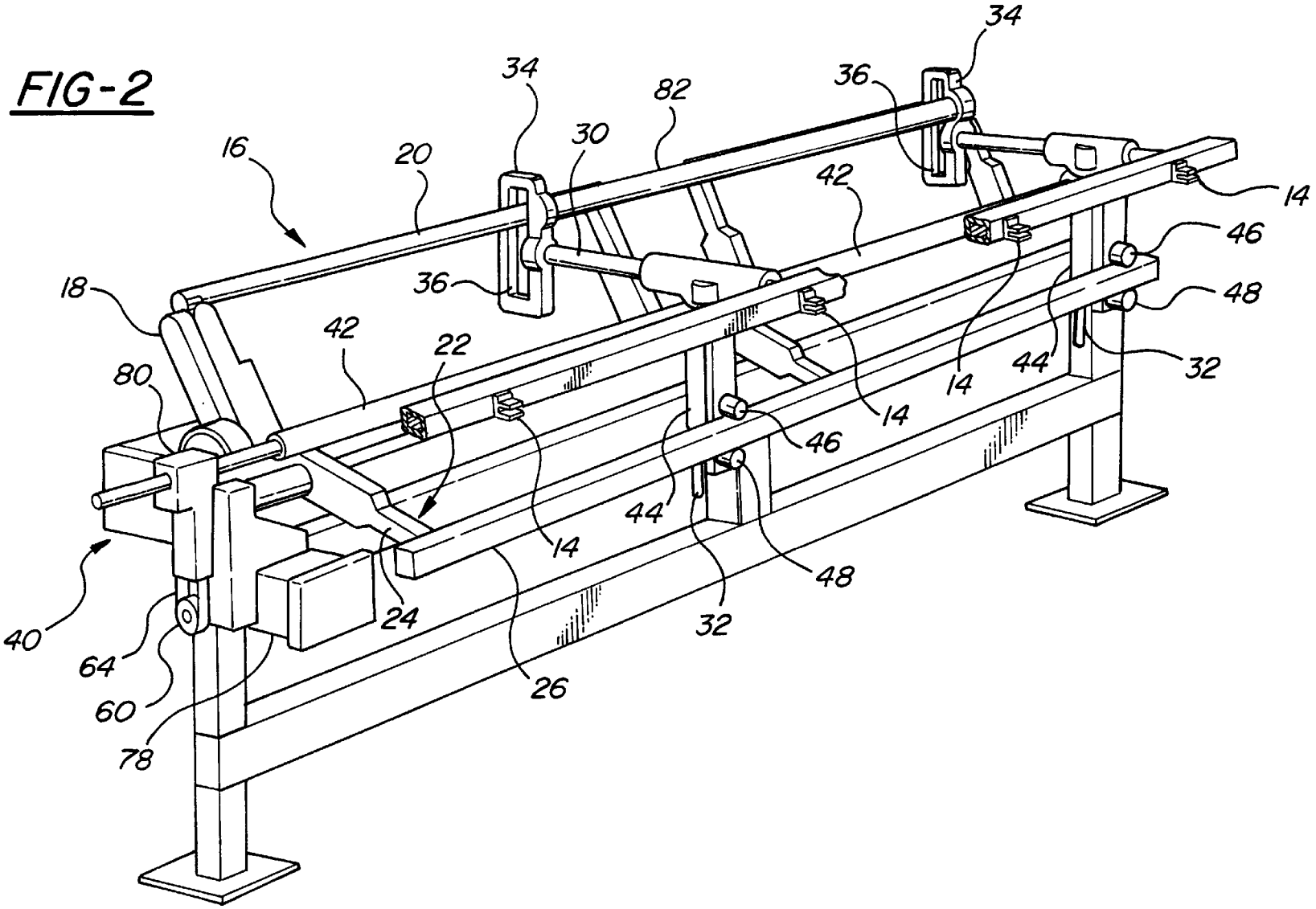
FIG. 2 is a perspective view of one of the reciprocating members of the subject invention.
Figure 3:
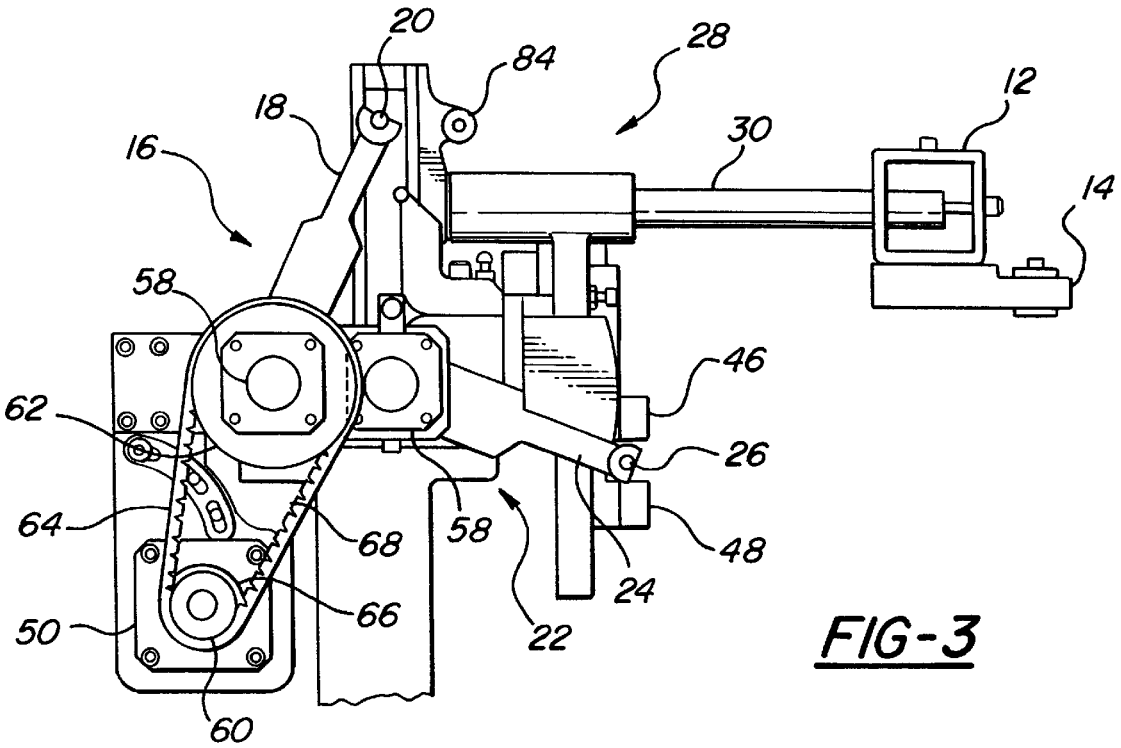
FIG. 3 is a front sectional view of the subject invention showing a horizontal motion mechanism in an upper work piece engagement position.
Figure 4:
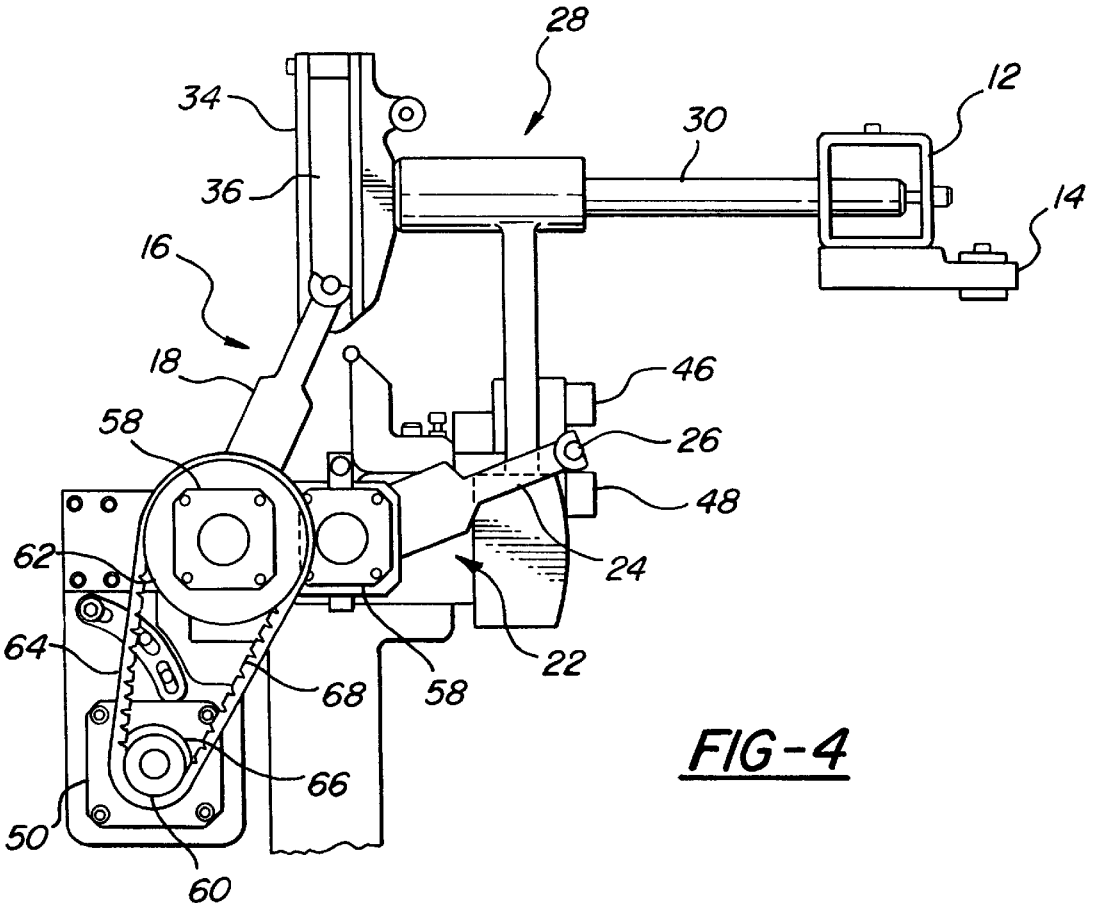
FIG. 4 is a front sectional view of the subject invention showing a horizontal motion mechanism in a lower workpiece engagement position.
Figure 5:
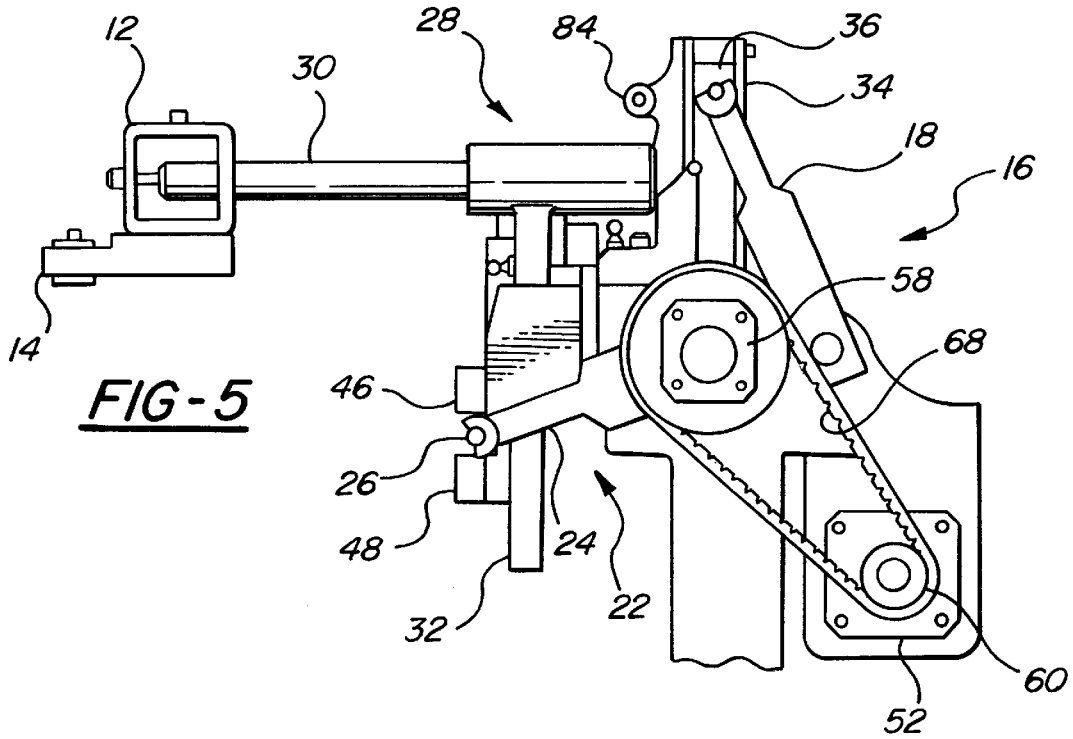
FIG. 5 is a rear sectional view of the subject invention showing a vertical motion mechanism in a lower workpiece engagement position.
Figure 6:
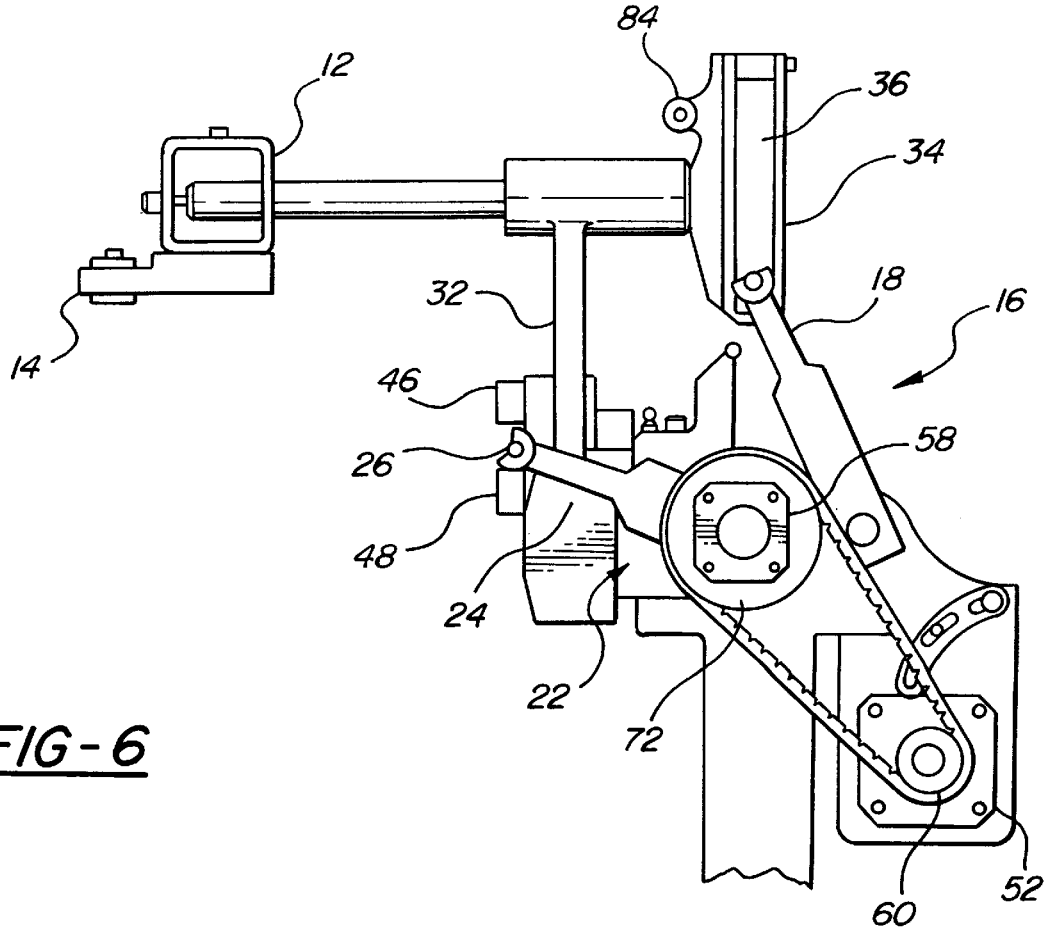
FIG. 6 is a rear sectional view of the subject invention showing a vertical motion mechanism in an upper workpiece engagement position.
Figure 7:
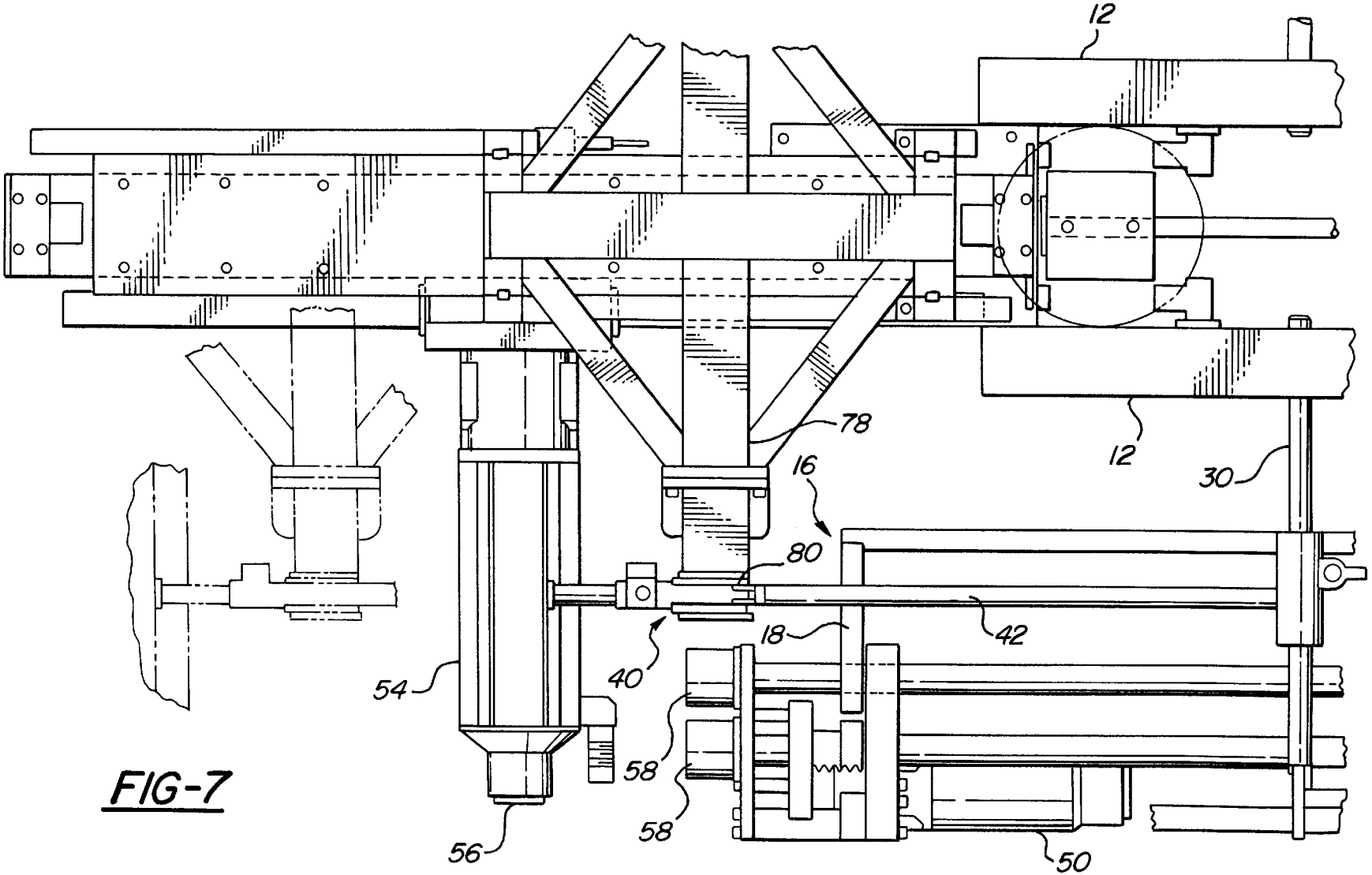
FIG. 7 is a top sectional view of the subject invention showing a lateral motion mechanism.
Figure 8:
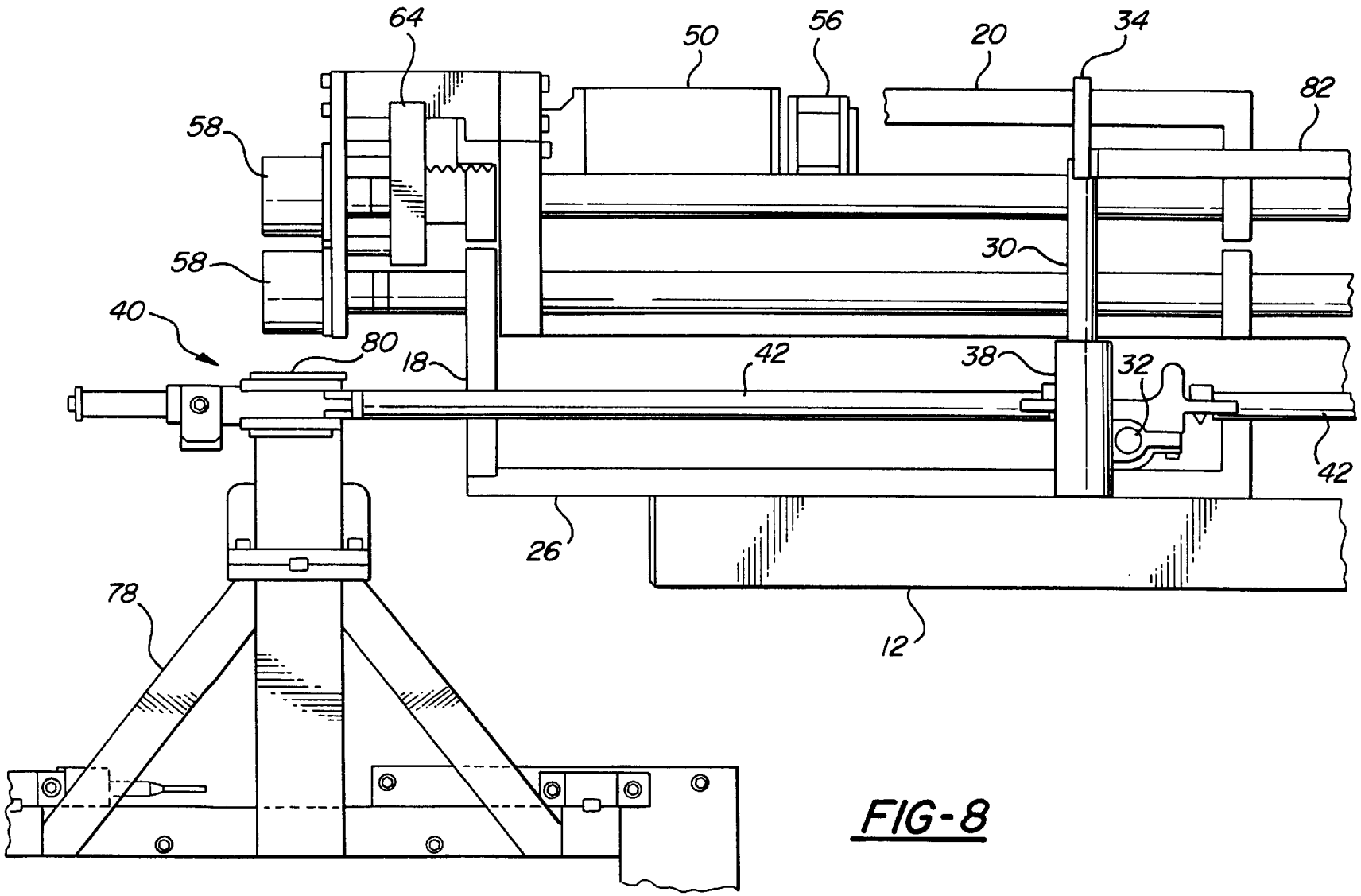
FIG. 8 is a top sectional view showing a horizontal motion mechanism.
Figure 9:
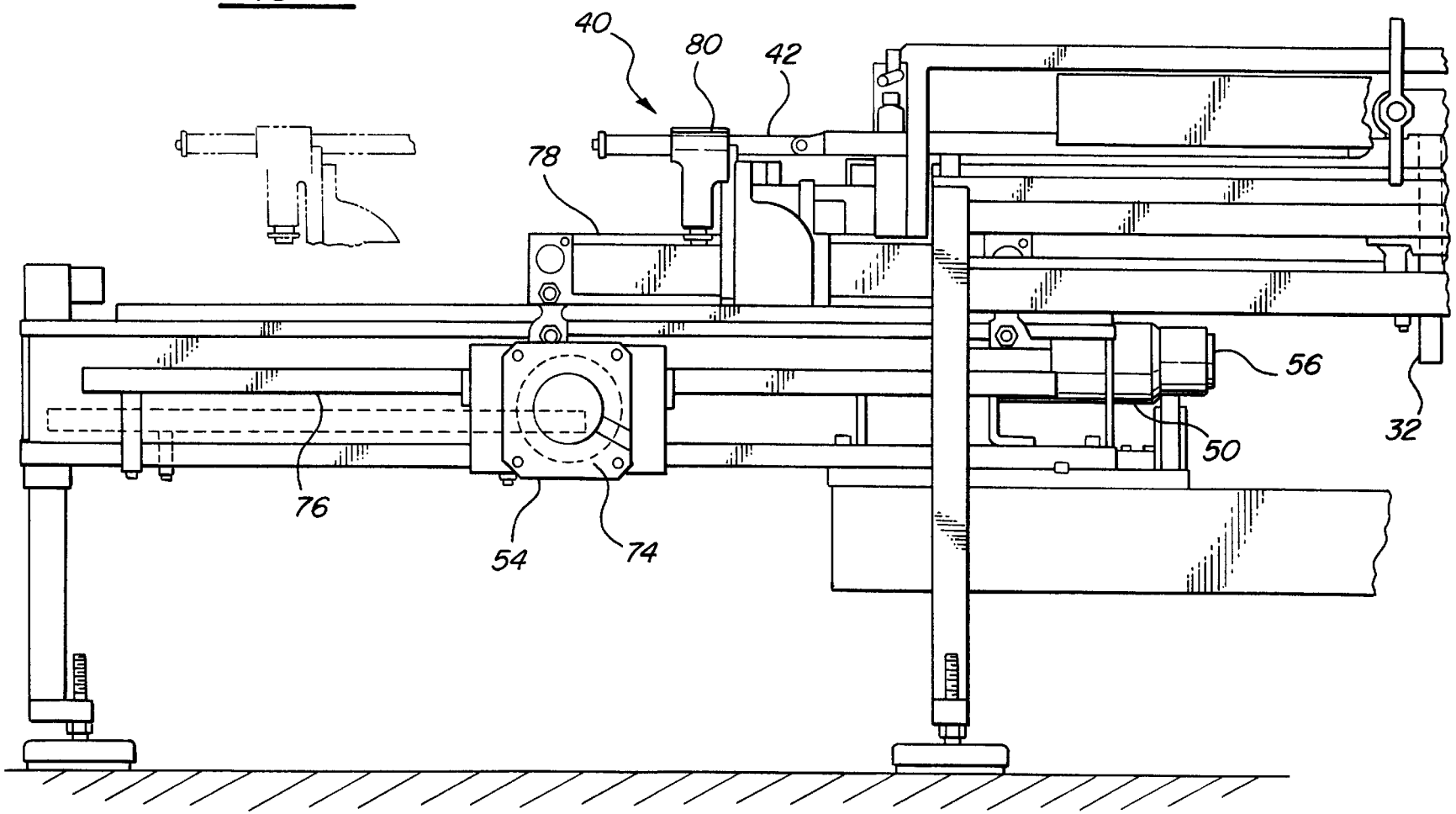
FIG. 9 is a side sectional view of the subject invention showing a lateral motion mechanism.

Referring to the Figures, wherein like numerals indicate like or corresponding parts throughout the several views, a workpiece transfer assembly for a press is generally shown at 10 including a reciprocating member and a series of in-line stations wherein each station is a further progression of the workpiece forming process. For convenience, a plurality of workpieces W are shown in FIG. 1.

The assembly 10 includes a workpiece engaging jaw 12 having clasps 14 attached thereto for clasping the workpieces W. A plurality of clasps 14, each corresponding to a workpiece W in a die station, are mounted on the jaw 12 and engage the workpieces W when the jaw 12 is in workpiece W engagement position as will be described further hereinbelow.

A lateral motion mechanism 16 moves the jaw 12 in a horizontal direction and laterally relative to the work stations into and out of workpiece W engagement position. The lateral motion mechanism 16 includes lateral motion arms 18 affixed at distal ends to a lateral motion bar 20 for transferring lateral motion to the lateral motion bar 20. The assembly 10 includes opposed lateral motion bars 20 for moving the jaw 12 laterally into and out of workpiece engagement position as a motion cycle may dictate.

A vertical motion mechanism 22 moves the jaw 12 in a vertical direction relative to the workstations. The vertical motion mechanism 22 includes vertical motion arms 24 affixed at distal ends to a vertical motion bar 26 for transferring motion to the vertical motion bar 26. The assembly 10 includes opposed vertical motion bars 26 for moving the jaw 12 in a vertical direction once the jaw 12 is in workpiece engagement position.

A motion transmitting mechanism 28 is disposed between the jaw 12 and the lateral motion mechanism 16 for providing positive horizontal motion transmission to the jaw 12 and for providing lost motion transmission in the vertical direction. The motion transmitting mechanism 28 allows the jaw 12 to be raised and lowered relative to the work stations while the lateral motion mechanism 16 remains in the workpiece engaging position.

For example, the motion transmitting mechanism 28 includes an horizontal linkage 30 extending between the jaw 12 and the lateral motion bar 20 for transferring lateral motion to the jaw 12 from the lateral motion bar 20. The horizontal linkage 30 preferably comprises an elongated tubular member having a constant circular cross section therealong.

The motion transmitting mechanism 28 also includes a vertical linkage 32 which extends between the vertical motion bar 26 and the horizontal linkage 30. The vertical linkage 32 transfers vertical motion to the jaw 12 from the vertical motion bar 26. That is to say, as the vertical motion bar 26 actuates, it moves the vertical linkage 32 between a raised and a lowered position which in turn moves the horizontal linkage 30 translating horizontal motion to the jaw 12. This is best represented in FIGS. 2 through 6. Preferably, the vertical linkage 32 comprises an elongated tubular member having a constant circular cross section therealong.

The motion transmitting mechanism 28 includes a plate 34 having a vertically elongated slot 36 disposed therein for transmitting positive horizontal motion in response to force applied horizontally to the slot 36 from the lateral motion bar 20, and for providing lost vertical motion within the slot 36 to the lateral motion bar 20 in response to force applied vertically from the vertical motion bar 26. The plate 34 is disposed on the outermost end to the horizontal linkage 30. The lateral motion bar 20 extends through the slot 36 so that during oscillation, the lateral motion bar 20 moves the horizontal linkage 30 in response to force applied to the inside surfaces of the slot 36, thereby providing positive motion transmission.

The motion transmitting mechanism 28 includes a linear type bearing 38 interconnecting the horizontal linkage 30 and the vertical linkage 32 for allowing the horizontal linkage 30 to be moved relative to the vertical linkage 32. The linear type bearing 38 is fixedly disposed on the vertical linkage 32. The horizontal linkage 30 extends through the bearing 38 for providing guided horizontal motion to the horizontal linkage 30. The linear type bearing 38 is rigidly positioned on the uppermost end of the vertical linkage 32, and the tubular horizontal linkage 30 extends through the bearing 38 for allowing the horizontal linkage 30 to move into and out of the workpiece W engagement position relative to the vertical linkage 32.

A linear motion mechanism 40 moves the jaw 12 in a horizontal direction and linearly relative to the work stations. The linear motion mechanism 40 includes a linear motion bar 42 affixed to a vertical type bearing 44 having the vertical linkage 32 slidably retained therein. As a result, the linear motion bar 42 translates linear motion to the jaw 12 independently of the vertical movement of the jaw 12 and does not move in a vertical direction. In operation, the linear motion bar 42 allows the motion transmitting mechanism 28 and the attached jaw 12 to move longitudinally relative to the work stations for indexing the workpieces to their respective next work stations.

The linear type bearing 38 includes at least one upper roller element 46 and at least one lower roller element 48 having the vertical motion bar 26 disposed therebetween for allowing unrestricted longitudinal movement of the vertical linkage 32 along the vertical motion bar 26. The rollers 46,48 are oriented to roll in a linear direction along the vertical motion bar 26 and to translate vertical motion from the vertical motion bar 26 to the vertical linkage 32 and subsequently to the jaw 12.

The assembly 10 is characterized by a reciprocal horizontal motor 50 for actuating the lateral motion mechanism 16, a reciprocal vertical motor 52 for actuating the vertical motion mechanism 22, and a linear motor 54 for actuating the linear motion mechanism 40. A controller (not shown) communicates with the motors 50,52,54 for cycling the motors through a programmed actuation process. A computer terminal (not shown) is used to program the controller with an operation cycle corresponding to a desired work station operation. The controller relays the operation cycle to the motors 50,52,54 for the motors 50,52,54 to execute an articulating movement. The motors may comprise any suitable type such as mechanical, electric servo, pneumatic, or hydraulic.

The motors 50,52,54 each include a motor encoder 56 for signaling the controller with an actuation location of the motors 50,52,54. The motor encoders 56 are affixed in a linear orientation to the motor's axle (not shown) for determining the rotation of motors's axle and relaying the rotation status to the controller. The vertical and the lateral motion mechanisms 16,22 each include a mechanism encoder 58 for signaling the controller with an actuation location of the mechanisms 16,22. The mechanism encoders 58 are positioned at the pivot point of the vertical motion arm 24 and the lateral motion arm 18. Thus, the mechanism encoders 58 determine the actuation position of the jaw 12 from the actuation position of the arms 18,24. The controller includes a comparator (not shown) for comparing the output of the motor encoders 56 with the output of the mechanisms 16,22 from the mechanism encoders 58 for correcting any operation errors between the motors 50,52,54 and the mechanisms 16,22. In addition, if the controller determines the motors 50,52,54 are out of alignment with the orientation of the motion arms 18,24, the controller will relay an error signal to the terminal and terminate the assembly 10 operation.

The lateral reciprocal motors 54 includes a lateral drive shaft 60, and the lateral motion mechanism 16 includes lateral input shafts 62. The lateral drive shafts 60 can take the form of a gear or a wheel and are affixed to the motor axle for transmitting articulating motion. The lateral drive shafts 60 transfer articulating motion to the lateral input shafts 62. The lateral input shafts 62 are affixed to the pivot point of the lateral motion arms 18 for translating articulating motion from the to the lateral motion arms 18.

The reciprocal lateral motors 54 include belts 64 for transferring articulating motion from the lateral drive shafts 60 to the lateral input shafts 62. The lateral shafts 60,62 include shaft teeth 66 and the belts 64 include belt teeth 68, the shaft teeth 66 and the belt teeth 68 are in running engagement. The teeth 66,68 provide a non-slip engagement between the shafts 60,62 and the belts 64. Other methods for achieving running engagement between the drive shafts and the input shafts are contemplated including chains and gears.

The reciprocal vertical motor 52 includes a vertical drive shaft 70, and the vertical motion mechanism 22 includes vertical input shafts 72. The vertical drive shafts 70 can take the form of a gear or a wheel and are affixed to the motor axle for transmitting articulating motion. The vertical drive shafts 70 transfer articulating motion to the vertical input shafts 72. The vertical input shafts 72 are affixed to the pivot point of the vertical motion arms 24 for translating articulating motion from the vertical drive shafts 70 to the vertical motion arms 24.

The reciprocal vertical motors 52 include belts 64 for transferring articulating motion from the vertical drive shafts 70 to the vertical input shafts 72. The vertical shafts 70 include shaft teeth 66 and the belts 64 include belt teeth 68, the shaft teeth 66 and the belt teeth 68 are in running engagement. The teeth 66 provide a non-slip engagement between the shafts 70,72 and the belt 64. Other methods for achieving running engagement between the drive shafts and the input shafts are contemplated including chains and gears.

The linear motor 54 includes a pinion 74 and the linear motion mechanism 40 includes a rack 76. The pinion 74 is in running engagement with the rack 76 for actuating the linear motion mechanism 40. The linear motor 54 is affixed to a linear motion frame 78. The linear motor 54 and the frame 78 move in a linear direction along the rack 76 as driven by the pinion 74. The actuation of the linear motor 54 is regulated by the controller. Different work station configurations require different lengths of travel for the pinion 74 along the rack 76 and can be programmed into the controller.

The linear motion mechanism 40 includes a clutch 80. The clutch 80 is in communication with the controller for disengaging the clutch 80 when an operation error in the linear direction is detected. The clutch 80 is affixed to the frame 78 and moves with the frame 78 along the rack 76. The clutch 80 grasps the linear motion bar 42 for transferring linear motion to the jaw 12. The clutch 80 signals the controller with faults in linear travel of the linear motion bar 42. The controller will respond by disengaging the clutch 80 from the linear motion bar 42 for preventing damage to the assembly 10 from forcing linear movement during a fault condition.

It is frequently desirable to interconnect two motion transmitting mechanisms 16,22 on each flank of the assembly 10 for use in tandem during the workpiece W transfer operation. Therefore, in the preferred embodiment, the assembly 10 includes a horizontal coupling bar 82 and a vertical coupling bar 84 for connecting one motion transmitting mechanism 28 to another for allowing the two to operate in tandem during the workpiece transferring operation. The vertical coupling bar 84 attaches between the vertical linear type bearings 38, and the horizontal coupling bar 82 attaches between the plates 34. As will be appreciated, the jaw 12 also serves to interconnect two tandemly operating motion transmitting mechanisms 28.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A workpiece transfer assembly (10) for a press of the type including a reciprocating member and a series of in-line stations wherein each station is a further progression of a workpiece W forming process, said assembly (10) comprising:

a pair of workpiece engaging jaws (12) each having clasps (14) attached thereto for clasping the workpieces W;

a lateral motion mechanism (16) for moving said jaw (12) in a horizontal direction and laterally relative to the work stations into and out of workpiece W engagement position;

a vertical motion mechanism (22) for moving said jaw (12) in a vertical direction relative to the workstations;

a linear motion mechanism (40) for moving said jaw (12) in a horizontal direction and linearly relative to said work stations;

each jaw (12) operatively connected to said mechanisms; and said assembly (10) characterized by a pair of reciprocal horizontal motors (50) each actuating one of said lateral motion mechanisms (16), a pair of reciprocal vertical motors (52) each actuating one of said vertical motion mechanisms (22), a linear motor (54) for actuating said linear motion mechanism (40), and a controller for programming said motors (50,52,54) through a programmed actuation process wherein said motors (50, 52,54) are mounted to said assembly in a stationary manner.

2. An assembly (10) as set forth in claim I including a motion transmitting mechanism (28) disposed between said jaw (12) and said lateral motion mechanism (16) for providing positive motion transmission to said jaw (12) and for providing lost motion transmission in the vertical direction to allow said jaw (12) to be raised and lowered relative to the work stations while said lateral motion mechanism (16) remains in the workpiece W engaging position.

3. An assembly (10) as set forth in claim 2 wherein said motors (50,52,54) each include a motor encoder (56) for signaling said controller with an actuation location of said motors (50,52,54).

4. An assembly (10) as set forth in claim 3 wherein said vertical and said lateral motion mechanisms (16, 22) each include a mechanism encoder (56) for signaling said controller with an actuation location of said mechanisms (16, 22).

5. An assembly (10) as set forth in claim 4 wherein said controller includes a comparator for comparing the output of said motors (50,52,54) from said motor encoders (56) with the output of said mechanisms (16, 22) from said mechanism encoders (58) for correcting an operation error between said motors (50,52,54) and said mechanisms (16, 22).

6. A workpiece transfer assembly (10) for a press of the type including a reciprocating member and a series of in-line stations wherein each station is a further progression of a workpiece W forming process said assembly (10) comprising:

a workpiece engaging jaw (12) having clasps (14) attached thereto for clasping the workpieces W;

a lateral motion mechanism (16) for moving said jaw (12) in a horizontal direction and laterally relative to the work stations into and out of workpiece W engagement position;

a vertical motion mechanism (22) for moving said jaw (12) in a vertical direction relative to the workstations;

a linear motion mechanism (40) for moving said jaw (12) in a horizontal direction and linearly relative to said work stations, a reciprocal horizontal motor (50) for actuating said lateral motion mechanism (16), a reciprocal vertical motor (52) for actuating said vertical motion mechanism (22), a linear motor (54) for actuating said linear motion mechanism (40), and a controller for programming said motors (50,52,54) through a programmed actuation process; and said reciprocal lateral motor (50) including a lateral drive shaft (60), and said lateral motion mechanism (16) including lateral input shafts (62), said lateral drive shafts (60) transferring articulating motion to said lateral input shafts (62).

7. An assembly (10) as set forth in claim 6 wherein said reciprocal lateral motor (50) includes belts (64) for transferring articulating motion from said lateral drive shafts (60) to said lateral input shafts (62).

8. An assembly (10) as set forth in claim 7 wherein said lateral shafts include shaft teeth (66) and said belts (64) include belt teeth (68), said shaft teeth (66) and said belt teeth (68) being in running engagement.

9. An assembly (10) as set forth in claim 8 wherein said reciprocal vertical motor (52) includes a vertical drive shaft (70), and said vertical motion mechanism (22) includes vertical input shafts (72), said vertical drive shafts (70) transferring articulating motion to said vertical input shafts (72).

10. An assembly (10) as set forth in claim 9 wherein said reciprocal vertical motor (52) includes belts (64) for transferring articulating motion from said vertical drive shafts (70) to said vertical input shafts (72).

11. An assembly (10) as set forth in claim 10 wherein said vertical shafts (70,72) include shaft teeth (66) and said belts (64) include belt teeth (68), said vertical shaft teeth (66) and said belt teeth (68) being in running engagement.

12. An assembly (10) as set forth in claim 11 wherein said linear motor (54) includes a pinion (74) and said linear motion mechanism (40) includes a rack (76), said pinion (74) being in running engagement with said rack (76) for actuating said linear motion mechanism (40).

13. An assembly (10) as set forth in claim 12 wherein said linear motion mechanism (40) includes a clutch (80), said clutch (80) being in communication with said controller for disengaging said clutch (80) when an operation error in the linear direction is detected.

* * * * *